US008142103B2

(12) United States Patent
Wolf

(10) Patent No.: US 8,142,103 B2
(45) Date of Patent: Mar. 27, 2012

(54) WIRELESS SENSOR WITH KINETIC ENERGY POWER ARRANGEMENT

(75) Inventor: Edward Wolf, Dayton, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 433 days.

(21) Appl. No.: 12/389,705

(22) Filed: Feb. 20, 2009

(65) Prior Publication Data

US 2010/0215434 A1 Aug. 26, 2010

(51) Int. Cl.
*E01C 23/07* (2006.01)

(52) U.S. Cl. ..... 404/84.1; 404/117

(58) Field of Classification Search ..... 404/84.1, 404/84.5, 117, 122, 128
See application file for complete search history.

(56) References Cited

U.S. PATENT DOCUMENTS

| | | | | |
|---|---|---|---|---|
| 255,137 | A | 3/1882 | Brown | |
| 279,476 | A | 6/1883 | Ball | |
| 983,742 | A | 2/1911 | Mead | |
| 3,153,993 | A * | 10/1964 | Keppler | 404/117 |
| 3,354,333 | A | 11/1967 | Henry-Baudot | |
| 3,559,027 | A | 1/1971 | Arsem | |
| 3,665,227 | A | 5/1972 | Busch | |
| 3,885,163 | A | 5/1975 | Toberman | |
| 3,909,647 | A | 9/1975 | Peterson | |
| 3,944,855 | A | 3/1976 | Le Van | |
| 4,032,829 | A | 6/1977 | Schenavar | |
| 4,056,746 | A | 11/1977 | Burtis | |
| 4,135,584 | A | 1/1979 | Smith et al. | |
| 4,153,117 | A | 5/1979 | Freese | |
| 4,237,395 | A | 12/1980 | Loudermilk | |
| 4,239,974 | A | 12/1980 | Swander et al. | |
| 4,282,442 | A | 8/1981 | Massinger | |
| 4,295,538 | A | 10/1981 | Lewus | |
| 4,297,391 | A | 10/1981 | Lindmayer | |
| 4,327,296 | A | 4/1982 | Weyers | |
| 4,360,860 | A | 11/1982 | Johnson et al. | |

(Continued)

FOREIGN PATENT DOCUMENTS

DE 202004015141 U1 12/2004

(Continued)

OTHER PUBLICATIONS

Spectra Precision, "The Most Profitable Way to Dig to Grade", Trimble Navigation Limited, www.spectraprecision.com, 2002, 5 pgs.

(Continued)

*Primary Examiner* — Gary S Hartmann
(74) *Attorney, Agent, or Firm* — Dinsmore & Shohl LLP

(57) ABSTRACT

A system and method for sensing surface compaction effected by a compactor machine of the type having a vibrating compacting roller, and providing a sensor signal indicating sensed surface compaction to a control mounted on the compactor machine, includes a sensor for sensing compaction and providing a signal indicating sensed surface compaction. The sensor is mounted on the compacting roller support of the compactor machine. The system includes a vibration-to-electric energy converter, mounted with the sensor on the compacting roller support and subjected to vibration. The converter converts the vibration energy to electric energy which may be supplied to the sensor and to a transmitter. The transmitter is powered by the electric energy from said vibration-to-electric energy converter and transmits the sensor signal to a receiver on the machine. The receiver provides the sensor signal to a control for the machine.

20 Claims, 4 Drawing Sheets

U.S. PATENT DOCUMENTS

| | | | | |
|---|---|---|---|---|
| 4,452,045 | A | | 6/1984 | Matlin et al. |
| 4,514,796 | A | | 4/1985 | Saulters et al. |
| 4,614,875 | A | | 9/1986 | McGee |
| 5,091,679 | A | | 2/1992 | Murty et al. |
| 5,164,641 | A | | 11/1992 | Quibel et al. |
| 5,387,853 | A | | 2/1995 | Ono |
| 5,391,953 | A | | 2/1995 | van de Veen |
| 5,507,352 | A | | 4/1996 | Frisbee et al. |
| 5,727,900 | A | * | 3/1998 | Sandstrom ..... 404/84.1 |
| 5,751,091 | A | | 5/1998 | Takahashi et al. |
| 5,782,018 | A | | 7/1998 | Tozawa et al. |
| 5,796,240 | A | | 8/1998 | Saito et al. |
| 5,797,107 | A | | 8/1998 | Berg et al. |
| 5,819,866 | A | | 10/1998 | Smith et al. |
| 5,822,278 | A | | 10/1998 | Ohshima et al. |
| 5,838,138 | A | | 11/1998 | Henty |
| 5,848,485 | A | | 12/1998 | Anderson et al. |
| 5,850,891 | A | | 12/1998 | Olms et al. |
| 5,862,501 | A | | 1/1999 | Talbot et al. |
| 5,873,612 | A | | 2/1999 | Connor |
| 5,880,532 | A | | 3/1999 | Stopher |
| 5,949,215 | A | | 9/1999 | Takakura |
| 6,012,838 | A | | 1/2000 | Hara et al. |
| D424,581 | S | | 5/2000 | Morita et al. |
| 6,099,235 | A | | 8/2000 | Cain et al. |
| 6,108,076 | A | | 8/2000 | Hansender |
| 6,109,363 | A | | 8/2000 | High |
| 6,120,177 | A | | 9/2000 | Hara et al. |
| 6,158,949 | A | | 12/2000 | Walth et al. |
| 6,233,511 | B1 | | 5/2001 | Berger et al. |
| 6,275,758 | B1 | | 8/2001 | Phelps |
| 6,278,955 | B1 | | 8/2001 | Hartman et al. |
| 6,281,594 | B1 | | 8/2001 | Sarich |
| 6,282,453 | B1 | | 8/2001 | Lombardi |
| 6,291,900 | B1 | | 9/2001 | Tiemann et al. |
| 6,360,459 | B1 | | 3/2002 | Brookhart et al. |
| 6,362,534 | B1 | | 3/2002 | Kaufman |
| 6,363,832 | B1 | | 4/2002 | Francis |
| 6,378,231 | B1 | | 4/2002 | Moriya et al. |
| 6,390,459 | B2 | | 5/2002 | Saitoh |
| 6,409,131 | B1 | | 6/2002 | Bentley et al. |
| 6,431,790 | B1 | * | 8/2002 | Anderegg et al. ..... 404/75 |
| 6,722,815 | B2 | * | 4/2004 | Fervers ..... 404/75 |
| 6,750,621 | B2 | * | 6/2004 | Gandrud ..... 318/114 |
| 6,752,567 | B2 | * | 6/2004 | Miyamoto et al. ..... 404/84.1 |
| 6,836,982 | B1 | | 1/2005 | Augustine |
| 6,856,879 | B2 | | 2/2005 | Arakawa et al. |
| 6,858,951 | B2 | | 2/2005 | Liao |
| 7,089,823 | B2 | | 8/2006 | Potts |
| 7,161,254 | B1 | | 1/2007 | Janky et al. |
| 2003/0146850 | A1 | | 8/2003 | Fallenstein |
| 2005/0248159 | A1 | | 11/2005 | Seoane |

FOREIGN PATENT DOCUMENTS

| | | |
|---|---|---|
| GB | 2439411 A | 12/2007 |
| WO | 0201086 A2 | 1/2002 |

OTHER PUBLICATIONS

Trimble, "Rugged and Dependable: Laser Receivers", http://www.trimble.com/news/061402a.htm, 2002, 3 pgs.

Trimble, "Versatile, Accurate and Easy to Use for a Range of Grading and Excavating Applications", http://www.trimble.com/cr600.html, 2002, 2 pgs.

Trimble, "The Most Profitable Way to Dig", http://www.trimble.com/bucketpro.html, 2002, 2 pgs.

Trimble News Releases, "Trimble Introduces Site Vision GPS System for Excavators", http://www.trimble.com/news/031902d.htm; Mar. 19, 2002, 3 pgs.

Trimble, "Blade Pro Motograder Control System: The Proven Way to Finish Faster", www.trimble.com, 2001, 4 pgs.

Trimble, "Take the Guess Work Out of Earthworks: Stakeless Grade Control", www.trimble.com, 7 pgs.

Trimble, "Tools for the Future. From a Long Tradition of Innovation", www.trimble.com, 2001, 1 pg.

Trimble, "Technical Notes: BladePro 3D Automatic Grade Control System—Nothing Finishes Faster", www.trimble.com, 2002, pp. 1-7.

Brain, M., "How Pendulum Clocks Work", http:/howstuffworks.com/clock.htm/printable, 1998, pp. 1-7.

Brain, M., "How Gear Ratios Work", http://howstuffworks.com/gear-ratio.htm/printable, 1998, pp. 1-10.

http://www.ncat.edu/~splash/shaft_encoder.htm; "Shaft Encoder", 2002, 1 pg.

PCT International Preliminary Report On Patentability, dated Sep. 1, 2011, PCT Application No. PCT/US2010/024673, filed Feb. 19, 2010, entitled Wireless Sensor With Kinectic Energy Power Arrangmenet, Applicant: Caterpillar Trimble Control Technologies, LLC.

International Search Report and Written Opinion dated Jun. 2, 2010 pertaining to International application No. PCT/US2010/024673.

* cited by examiner

WIRELESS SENSOR WITH KINETIC ENERGY POWER ARRANGEMENT

CROSS-REFERENCE TO RELATED APPLICATION

Not applicable.

STATEMENT REGARDING FEDERALLY SPONSORED RESEARCH OR DEVELOPMENT

Not applicable.

BACKGROUND OF THE INVENTION

Compactor machines are used extensively in construction projects to compact soil, asphalt, gravel, and other similar materials. Typically such machines include mechanisms that vibrate at controlled frequencies and amplitudes while pressing down on the surface of the material to be compacted. Such a machine and control is a machine control are disclosed in U.S. Pat. No. 7,089,823, issued Aug. 15, 2006, to Potts, the disclosure of which is incorporated herein by reference. Potts shows a vibratory compactor that uses vibrating mechanisms within compaction rollers. Vibrations are imparted to the rollers as the compactor machine is driven over the surface enhancing the compaction process. Each vibrating mechanism typically includes weights that rotate about a common axis, with the weights being eccentrically position with respect to the common axis to produce varying degrees of imbalance during rotation. The amplitude of the vibrations produced by the arrangement is varied by changing the relative position of the eccentric weights to vary the average distribution of mass. Varying the rotational speed of the weights about their common axis changes the frequency of the vibrations produced by the arrangement.

It is known to determine the degree of compaction of the material by monitoring the reflected vibrations that are returned to the compactor machine. Those reflected vibrations may be sensed by appropriate sensors carried on the machine. The vibrations may in fact pass from the compaction surface, through the rollers, and be detected by appropriately positioned sensors on or adjacent the roller support. As is known, optimal compaction varies from material to material, and it is preferable that the material not be compacted too much or too little. To achieve this, the degree of compaction can be determined by sensors on the machine which receive reflections of kinetic energy. The sensors are mounted at a distance from the machine control, and the sensor outputs must therefore be supplied to the machine control, typically by cable. Additionally, the sensors typically require a power supply, and this power also is provided over additional wires or cables. Such wires or cables can be problematic, however, for a number of reasons. For example, they run to various parts of the machine which can be subject to a harsh environment, causing them be damaged or broken fairly quickly. Further, sensor wires and cables can limit the relative movement of machine components.

SUMMARY OF THE INVENTION

A system for sensing surface compaction effected by a compactor machine of the type having a vibrating compacting roller provides a sensor signal indicating sensed surface compaction to the compactor machine. The sensor signal may be provided to a control mounted on the compactor machine. The system includes a sensor for sensing compaction and providing a signal indicating sensed surface compaction. The sensor is mounted on the compacting roller support of the compactor machine. The system further includes a vibration-to-electric energy converter that is mounted with the sensor on the compacting roller support and is subjected to vibration. The converter converts vibration to electric energy and supplies this energy to the sensor. The system also includes a transmitter, powered by the electric energy from the vibration-to-electric energy converter and responsive to the sensor, for transmitting the sensor signal. Finally, the system has a receiver on the machine for receiving the sensor signal from the transmitter and providing the sensor signal to the control. The vibration-to-electric energy converter may include a generator having a permanent magnet. The generator may comprise a linear permanent magnet generator.

A method for sensing surface compaction effected by a compactor machine of the type having a vibrating compacting roller, and providing a sensor signal indicating surface compaction to the compactor machine, comprises the steps of converting the vibration motion of the compactor machine roller to electric energy while the roller is vibrating using a vibration-to-electric energy converter, supplying the electric energy to a vibration sensor on the vibrating compacting roller mounting, producing a signal with the vibration sensor and supplying the signal to a short range transmitter, and transmitting the signal wirelessly to the machine. The method may further comprise the step of receiving the signal that is wirelessly transmitted to the machine with a receiver, and then supplying the received signal to a machine control. The received signal may then be displayed on a display on the machine. The method may further comprise the step of controlling operation of the compactor machine based on the sensor signal. The method may include the further step of sensing reflected vibration to provide an indication of compaction level. The step of transmitting the signal wirelessly to the machine may include the step of transmitting the signal via radio transmission wirelessly to the machine.

The system may further comprise a second transmitter for communicating from the machine to the sensor, and a second receiver for receiving communications from the second transmitter. Additionally, the system may comprise a battery connected to the sensor for powering the sensor in conjunction with the converter. The method may further include the step of wirelessly communicating from the compactor machine to the sensor. The method may also include the step of powering the sensor using a battery in conjunction with the converter.

DETAILED DESCRIPTION OF THE PREFERRED EMBODIMENTS

Figure 1:
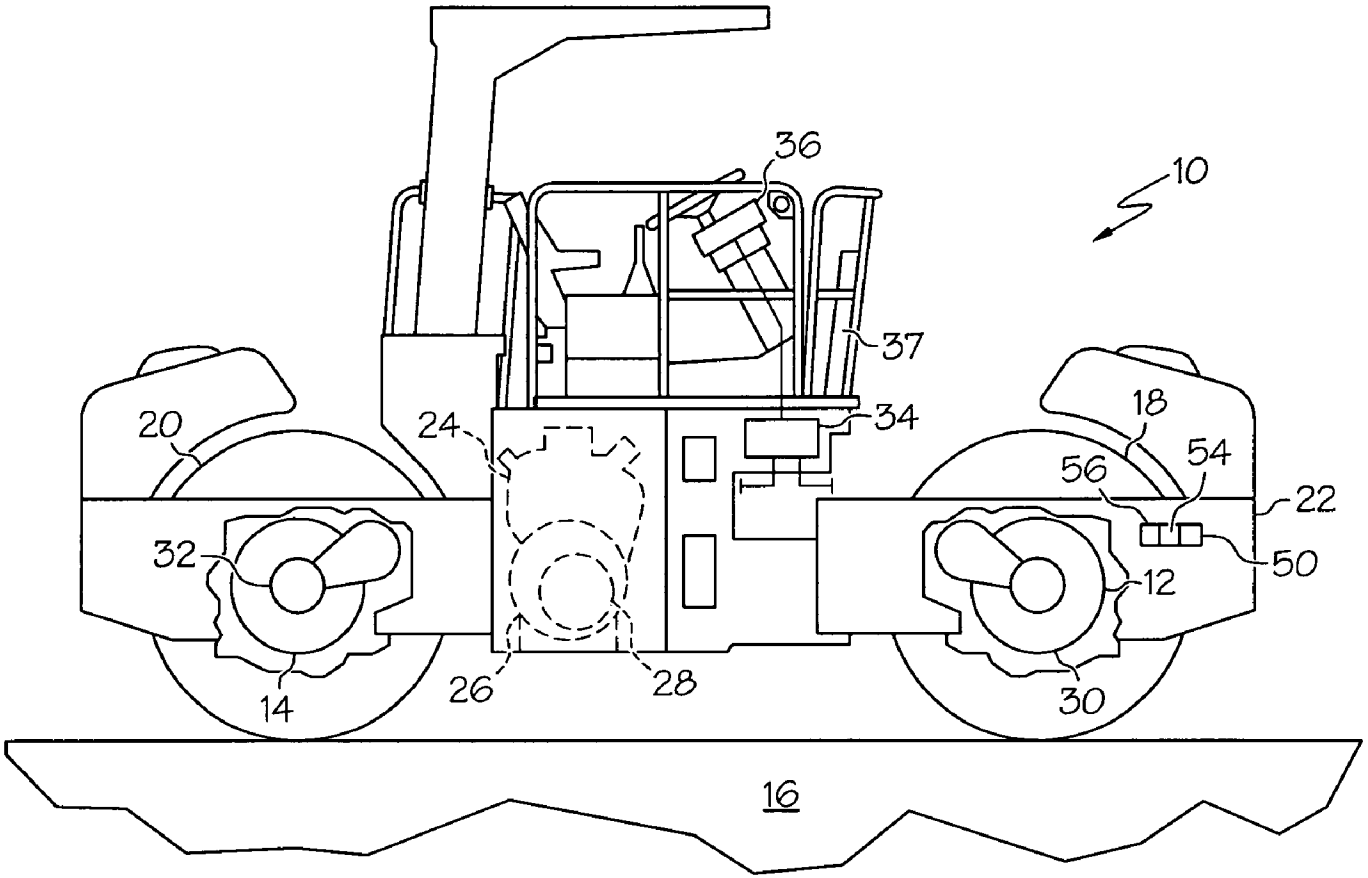
FIG. 1 is a side elevation view of a vibratory compactor, with portions broken away to reveal interior components.

FIG. 1 is an exemplary side elevation view of a vibratory compactor machine 10 having vibratory mechanisms 12 and 14. As is generally known, a machine such as the vibratory compactor machine 10 may be used to increase the density, that is, compact layer of a freshly laid material 16, such as, for example, asphalt, other bituminous mixtures, soil, gravel, or other compactable material. The vibratory compactor machine 10 may include a pair of compacting drums or rollers 18 and 20, that are rotatably mounted to a main frame 22, and that surround respective vibratory mechanisms 12 and 14. The main frame 22 supports an engine 24 that is used to generate mechanical or electrical power for propelling the compactor machine 10.

A pair of power sources 26 and 28 connected to the engine 24 in a conventional manner or in any other suitable manner. The power sources 26 and 28 may be electric generators, fluid pumps or any other source of power suitable for propelling the compactor machine 10, providing power to the vibratory mechanisms 12 and 14, and for providing power to mechanical subsystems and electrical systems that are associated with the compactor machine 10. It will be appreciated that a compactor machine may be utilized in which there is only a single vibrating compacting roller.

The vibratory mechanisms 12 and 14 may be operatively coupled to respective motors 30 and 32. While each of the compacting drums or rollers 18 and 20 is shown as having only one vibratory mechanism, additional vibratory mechanisms may be used in either or both of the drums 18 and 20, if desired. Where the power sources 26 and 28 provide electrical power, the motors 30 and 32 may be electric motors such as, for example, direct current motors. Alternatively, where the power sources 26 and 28 provide mechanical or hydraulic power, the motors 30 and 32 may be fluid motors. In any case, the motors 30 and 32 are operatively coupled to the power sources 26 and 28 via appropriate electrical wires or cables, relays, fuses, fluid conduits, or control valves, not shown, as needed.

The compactor machine 10 includes a controller 34 that may be used to control the amplitude and the frequency of the vibrations produced by one or both of the vibratory mechanisms 12 and 14. The controller 34 may be operatively coupled to an operator or user interface 36 that permits the user or operator of the compactor machine 10 to vary the characteristics of the vibrations produced by the vibratory mechanisms 12 and 14, set a desired vibration control mode, and determine if one or both of the compactor drums 18 and 20 should be caused to vibrate. A display 37 is responsive to the control 34 and permits the operator to view operational status or conditions associated with the compactor machine 10. The user interface 36 may be connected to the controller 34 and to other elements of the compactor machine 10 via conductive cables, optical fibers, or wireless communication links, such as for example radio frequency, infrared, and ultrasonic communication.

Figure 2:
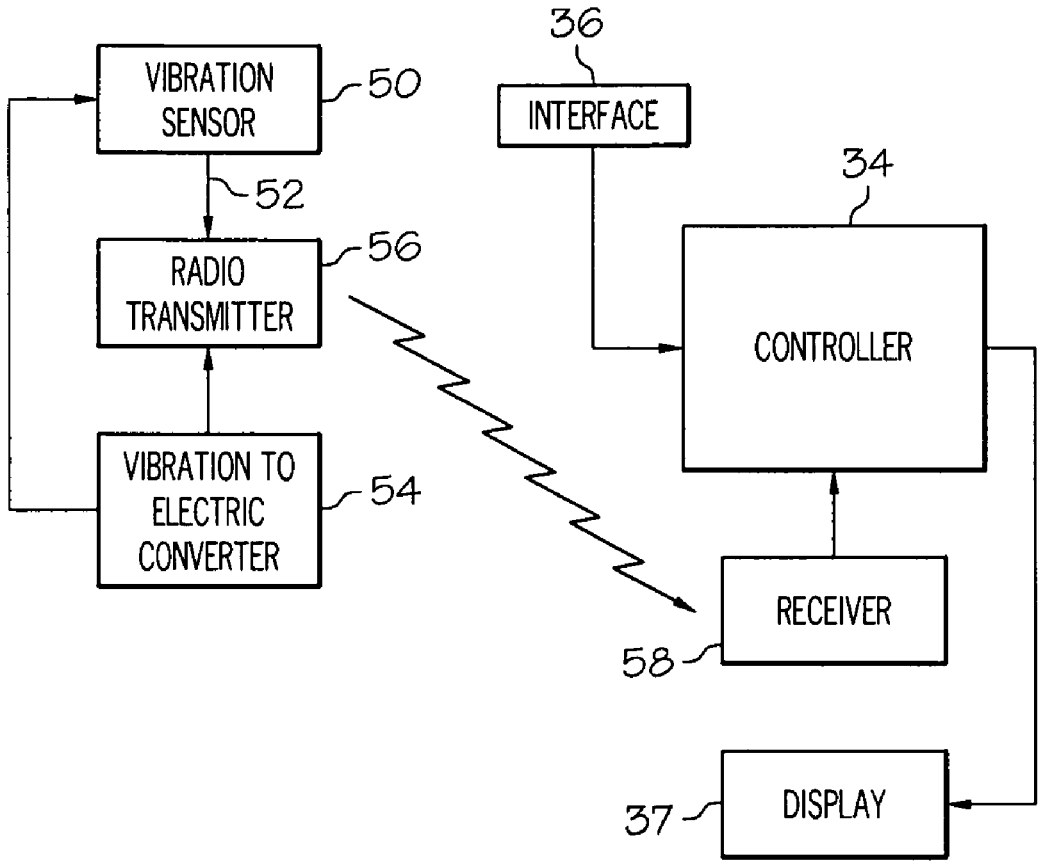
FIG. 2 is a schematic block diagram of a sensor and control, and associated components.

A system for sensing surface compaction effected by the compactor machine 10 and providing a sensor signal indicating sensed surface compaction to control 34 mounted on the compactor machine 10 is shown in FIG. 2. The system includes a sensor 50 for sensing compaction and providing a signal on line 52 indicating sensed surface compaction. The sensor 50 may be mounted on the compacting roller support, such as frame 22, or it may be mounted adjacent the axle support for the drum or roller 18 of the compactor machine 10. The system further includes a vibration-to-electric energy converter 54 that is mounted with the sensor 50 on the compacting roller support 22 and subjected to vibration which it converts to electric energy that is then supplied to said sensor 50. A transmitter 56, powered by the electric energy from the vibration-to-electric energy converter 54, is responsive to the sensor 50. Sensor 56 transmits the sensor signal wirelessly to a receiver 58 on said machine 10. The receiver 58 receives the sensor signal from said transmitter 56 and provides the sensor signal to controller 34. Controller 34 then displays information about the compaction on display 37 for the operator to view, or it may use the compaction information in other ways, such as for example changing the amplitude or frequency of the vibrations imparted by the rollers 18 and 20 to the surface of the material 16. It will be appreciated, however, that the control 34 may simply map the compaction information and develop a database of the degree of compaction of the material over which the machine travels. This information may be used later by other equipment.

Figure 3:
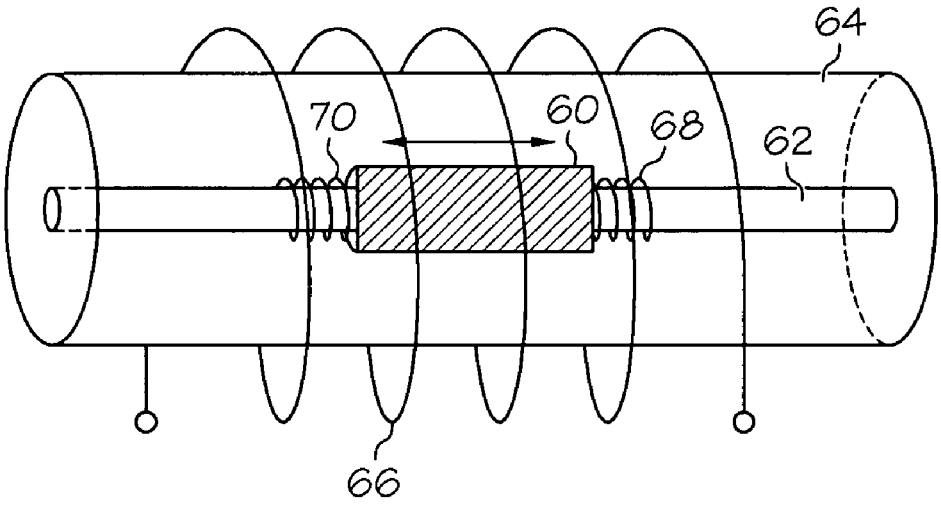
FIG. 3 is a first variation of a vibration-to-electric energy converter.
Figure 4:
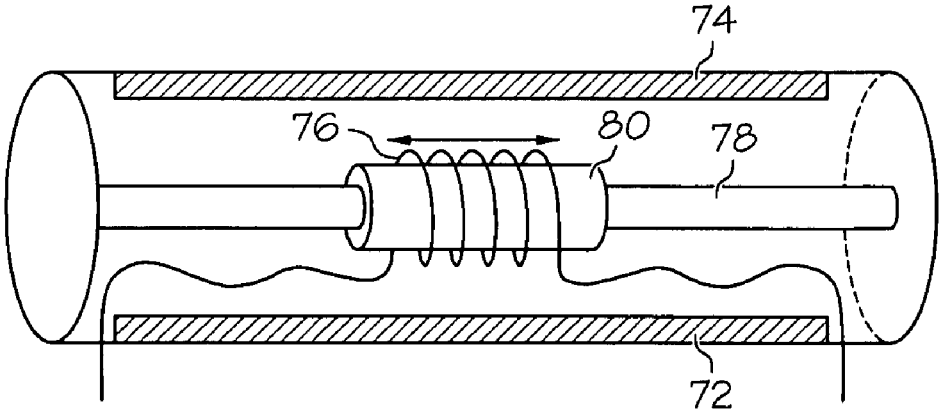
FIG. 4 is a second variation of a vibration-to-electric energy converter.

FIGS. 3 and 4 show two variations of a vibration-to-energy converter of the type that may be used. In the vibration-to-energy converter of FIG. 3, a permanent magnet 60 slides on a support rail 62 within a housing 64. The housing is made of a non-metallic material so that it does not shield coil 66 from the fluctuating magnetic field produced by the moving magnet. The magnet 60 may have a pair of coil springs 68 and 70 on opposite sides so that it tends to be returned to the center of the rail 62 after being shifted away from that point by vibrations. Movement of the magnet 60 produces an electric current in coil 66. In the vibration-to-energy converter of FIG. 4, on the other hand, a pair of stationary magnets 72 and 74 provides a stationary magnetic field through which a movable coil 76 passes as it slides along rail 78 on coil support 80. The movement of the coil 76 causes an electric current to be produced in the coil. It will be appreciated that both of the variations are linear permanent magnet generator.

The system had shown in FIGS. 1 and 2 supplies the sensed vibration signal to the control 34 via a short range transmitter 56 which transmits the signal wirelessly to the machine controller 34. The compaction information derived from the signal can be displayed, used to control operation of the machine, or both. Alternatively, the compaction information can simply be stored for later use. FIG. 2 shows a radio transmitter being used for transmitting the vibration signal to the controller 34. It should be understood, however, that other short range transmission techniques may be used, including infrared transmission.

Figure 5:
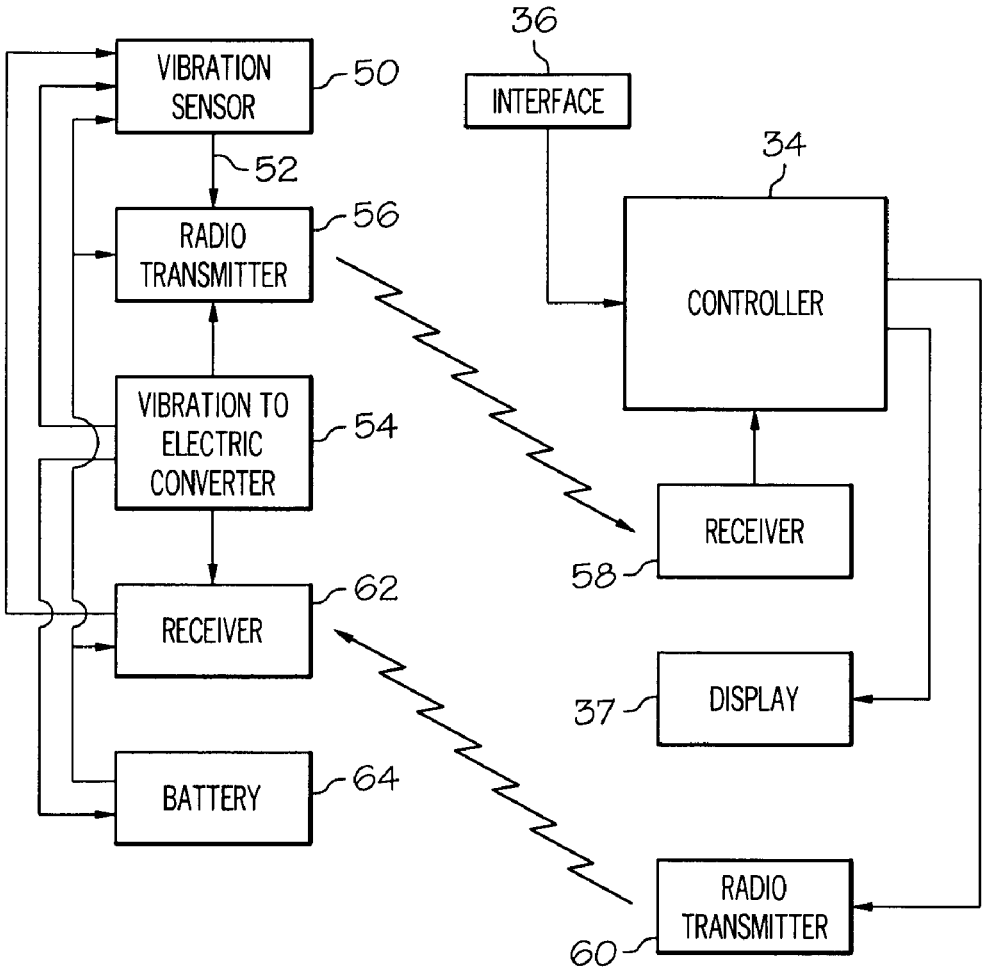
FIG. 5 is a schematic block diagram of a variation of the sensor and control, and associated components of FIG. 2, with like elements being labeled with the same reference numerals as used in FIG. 2.

FIG. 5 shows a variation of the sensor, controller, and associated components of FIG. 2, providing for two-way communication between the sensor 50 and the controller 34. To this end, the controller 34 may send a signal via short range radio transmitter 60 to receiver 62. Receiver 62 then supplies the received signal to vibration sensor 50. By this arrangement, the controller 34 may effect a number of changes wirelessly in the sensor 50. For example, the settings of the sensor 50 may be adjusted. These settings include the data reporting rate and the filtering parameters of the sensor 50. Alternatively, the controller 34 may cause new firmware to be downloaded to the sensor 50 if the sensor 50 is of the type which stores firmware.

It will be noted that FIG. 5 shows the addition of a battery 64 associated with the powering vibration sensor 50, radio transmitter 56 and receiver 62. The battery 64, which may also be included in the system of FIG. 2, provides a source of power for the sensor 50, radio transmitter 56 and receiver 62, either as a primary power source, or only for those periods of time during which there is no vibration, and thus no power from converter 54. If desired, the battery 64 may be the primary power source and may be recharged when the converter 54 experiences vibration and thus provides an electrical power output. The sensor may be switched on and off in a duty cycle fashion to reduce the amount of power from battery 64 that is consumed.

Other aspects, objects, and advantages of the embodiments can be obtained from a study of the drawings, the disclosure, and the appended claims.

What is claimed is:

1. A system for sensing surface compaction effected by a compactor machine of the type having a vibrating compacting roller, and providing a sensor signal indicating sensed surface compaction to a control mounted on the compactor machine, comprising a sensor for sensing compaction and providing a signal indicating sensed surface compaction, said sensor being mounted on the compacting roller support of said compactor machine, a vibration-to-electric energy converter, mounted with said sensor on said compacting roller support and subjected to vibration which it converts to electric energy, said electric energy being supplied to said sensor, a transmitter, powered by the electric energy from said vibration-to-electric energy converter and responsive to said sensor, for wirelessly transmitting said sensor signal, and a receiver on said machine for receiving said sensor signal from said transmitter and providing said sensor signal to said control.

2. The system for sensing surface compaction effected by a compactor machine of the type having a vibrating compacting roller, and providing a sensor signal indicating sensed surface compaction to a control mounted on the compactor machine of claim 1, wherein the vibration-to-electric energy converter includes a generator having a permanent magnet.

3. The system for sensing surface compaction effected by a compactor machine of the type having a vibrating compacting roller, and providing a sensor signal indicating sensed surface compaction to a control mounted on the compactor machine of claim 2, wherein the generator comprises a linear permanent magnet generator.

4. A method for sensing surface compaction effected by a compactor machine of the type having a vibrating compacting roller, and providing a sensor signal indicating surface compaction to a control on the compactor machine, comprising the steps of converting the vibration motion of the compactor machine roller to electric energy while the roller is vibrating using a vibration-to-electric energy converter, supplying the electric energy to a vibration sensor on the vibrating compacting roller mounting, producing a signal with the vibration sensor and supplying the signal to a short range transmitter, and transmitting the signal wirelessly to the machine.

5. The method for sensing surface compaction effected by a compactor machine of the type having a vibrating compacting roller, and providing a sensor signal indicating surface compaction to a control on the compactor machine of claim 4, further comprising the step of receiving the signal wirelessly transmitted to the machine with a receiver, and supplying the received signal to a machine control.

6. The method for sensing surface compaction effected by a compactor machine of the type having a vibrating compacting roller, and providing a sensor signal indicating surface compaction to a control on the compactor machine of claim 5, further comprising the step of displaying the received signal on a display on the machine.

7. The method for sensing surface compaction effected by a compactor machine of the type having a vibrating compacting roller, and providing a sensor signal indicating surface compaction to a control on the compactor machine of claim 4, further comprising the step of controlling operation of the compactor machine based on the sensor signal.

8. The method for sensing surface compaction effected by a compactor machine of the type having a vibrating compacting roller, and providing a sensor signal indicating surface compaction to a control on the compactor machine of claim 4, further comprising the step of sensing reflected vibration to provide an indication of compaction level.

9. The method for sensing surface compaction effected by a compactor machine of the type having a vibrating compacting roller, and providing a sensor signal indicating surface compaction to a control on the compactor machine of claim 4, in which said step of transmitting the signal wirelessly to the machine includes the step of transmitting the signal via radio transmission wirelessly to the machine.

10. A system for sensing vibrations returned to a compactor machine, and providing a sensor signal indicating sensed vibration to a control mounted on the compactor machine, comprising a vibration-to-electric energy converter, mounted on said compactor machine and subjected to vibration which it converts to electric energy, a sensor, mounted on said compactor machine, for sensing vibration on the machine and providing a signal indicating such vibration, said sensor being positioned at a distance from the control and powered by the electric energy from said vibration-to-electric energy converter, a radio transmitter, powered by the electric energy from said vibration-to-electric energy converter and responsive to said sensor, for transmitting the sensor signal, and a radio receiver on said machine for receiving the sensor signal from said transmitter and providing said sensor signal to said control.

11. The system for sensing vibrations returned to on a compactor machine, and providing a sensor signal indicating sensed vibration to a control mounted on the compactor machine, according to claim 10, wherein the vibration-to-electric energy converter includes a generator having a permanent magnet.

12. The system for sensing vibrations returned to on a compactor machine, and providing a sensor signal indicating sensed vibration to a control mounted on the compactor machine, according to claim 11, wherein the generator comprises a linear permanent magnet generator.

13. A system for sensing surface compaction effected by a compactor machine of the type having a vibrating compacting roller, and providing a sensor signal indicating sensed surface compaction, comprising a sensor for sensing compaction and providing a signal indicating sensed surface compaction, said sensor being mounted on the compacting roller support of said compactor machine, a vibration-to-electric energy converter, mounted with said sensor on said compacting roller support and subjected to vibration, said converter supplying electric energy to said sensor, a first transmitter, powered by the electric energy from said vibration-to-electric energy converter and responsive to said sensor, for transmitting said sensor signal, and a first receiver on said machine for receiving said sensor signal from said first transmitter.

14. The system for sensing surface compaction effected by a compactor machine of the type having a vibrating compacting roller, and providing a sensor signal indicating sensed surface compaction of claim 13, wherein the vibration-to-electric energy converter includes a generator having a permanent magnet.

15. The system for sensing surface compaction effected by a compactor machine of the type having a vibrating compacting roller, and providing a sensor signal indicating sensed surface compaction of claim 14, wherein the generator comprises a linear permanent magnet generator.

16. The system for sensing surface compaction effected by a compactor machine of the type having a vibrating compacting roller, and providing a sensor signal indicating sensed surface compaction of claim 13, further comprising a second transmitter for communicating from the machine to the sensor, and a second receiver for receiving communications from said second transmitter.

17. The system for sensing surface compaction effected by a compactor machine of the type having a vibrating compacting roller, and providing a sensor signal indicating sensed surface compaction of claim 13, further comprising a battery connected to said sensor for powering said sensor in conjunction with said converter.

18. A method for sensing surface compaction effected by a compactor machine of the type having a vibrating compacting roller, and providing a sensor signal indicating surface compaction to the compactor machine, comprising the steps of converting the vibration motion of the compactor machine roller to electric energy while the roller is vibrating using a vibration-to-electric energy converter, supplying the electric energy to a vibration sensor on the vibrating compacting roller mounting, producing a signal with the vibration sensor and supplying the signal to a short range transmitter, and transmitting the signal wirelessly to the compactor machine.

19. The method for sensing surface compaction effected by a compactor machine of the type having a vibrating compacting roller, and providing a sensor signal indicating surface compaction to the compactor machine of claim 18, further comprising the step of wirelessly communicating from the compactor machine to the sensor.

20. The method for sensing surface compaction effected by a compactor machine of the type having a vibrating compacting roller, and providing a sensor signal indicating surface compaction to the compactor machine of claim 18, further comprising the step of powering said sensor using a battery in conjunction with said converter.

* * * * *